US005086527A

United States Patent [19]

Takahashi et al.

[11] Patent Number: 5,086,527

[45] Date of Patent: Feb. 11, 1992

[54] FOLDING BABY BED

[75] Inventors: Takehiko Takahashi, Tokyo; Takahiro Sato; Yuji Shimizu, both of Aichi, all of Japan

[73] Assignees: Toyoda Gosei Co., Ltd., Aichi; Combi Corporation, Tokyo, both of Japan

[21] Appl. No.: 567,515

[22] Filed: Aug. 16, 1990

[30] Foreign Application Priority Data

Oct. 12, 1989 [JP] Japan ..... 1-119519[U]

[51] Int. Cl.[5] ..... A47C 17/40; A47D 7/00

[52] U.S. Cl. ..... 5/136; 5/424; 5/93.2; 108/38; 108/42

[58] Field of Search ..... 5/133, 136, 424, 9.1, 5/94, 93.1, 93.2; 312/248; 108/38, 42, 152, 134

[56] References Cited

U.S. PATENT DOCUMENTS 4,613,996 9/1986 Chase et al. ..... 5/136
4,876,970 10/1989 Bolduc ..... 312/248
4,965,896 10/1990 Berger et al. ..... 5/424

FOREIGN PATENT DOCUMENTS 61-100298 6/1986 Japan .
1-101928 4/1989 Japan .
2-23200 6/1990 Japan .

OTHER PUBLICATIONS

"Bedlift ®" A Trade brochure from the Häfle Co., 1988.

"Baby Changing Station", an ad on p. 10 of the Oct. 1988 issue of Small World Magazine.

*Primary Examiner*—Alexander Grosz
*Attorney, Agent, or Firm*—Sughrue, Mion, Zinn, Macpeak & Seas

[57] ABSTRACT

A folding baby bed has a vertically-long rectangular housing frame body portion which can be fixedly attached to a wall surface, a floor surface, or the like, at a back or bottom portion of the housing frame, and a bed portion provided at a front upper half portion of the housing frame body portion, the bed portion being pivotally attached to the housing frame body portion at opposite sides so that the bed portion can be horizontally extended and vertically folded so as to be housed in the housing frame body portion. The bed portion is constructed by upper and lower plates and a trim such that the trim is interposed between the upper and lower plates. When the bed portion is either in a vertically folded state or in a horizontally extended state, the state can be safely maintained by a supporting spring.

8 Claims, 6 Drawing Sheets

FOLDING BABY BED

BACKGROUND OF THE INVENTION

The present invention relates to an improvement for a folding baby bed for use when a baby is to be laid down for a short time or when a diaper or clothes of a baby is to be changed in a public place, particularly in a public lavatory or toilet or the like.

In the case where a woman who goes out with a baby, specifically a young baby wants to use a public lavatory or toilet or the like or wants to change a diaper or clothes of the baby, the woman sometimes experiences much inconvenience in that typically there is no space suitable for keeping the baby in an unattended state or for changing a diaper with the baby laid down.

In order to cope with these problems, baby circles i.e., a baby bed or the like for laying down babies therein have been recently prepared in lavatories or toilets of department stores, railway stations, and so on. However, the following problems result. That is, since such a baby circle is relatively large in size, the area occupied by the baby circle in the toilet room is also large. Further, since the baby circle per se can not be folded, a large space is always required for providing the baby circle therein, even during an unused time, thereby making the effective area in the toilet room narrow. As a result, there are typically limitations in space for setting up such a baby circle therein.

SUMMARY OF THE INVENTION

It is therefore an object of the present invention to solve the above problems.

It is another object of the present invention to provide a folding baby bed which can be easily mounted and used (in practice) in a narrow space such as a corner portion of a lavatory or toilet or the like, and the bed portion of which can be folded in the unused time so that the area occupied by the baby bed can be made extremely small.

It is a further object of the present invention to provide a baby bed in which a baby laid down on the bed can be safely controlled.

It is yet another object of the present invention to provide a baby bed improved in design and safety.

It is yet further object of the present invention to provide a baby bed which can be constructed by components of which high dimentional accuracy is not required, to thereby reduce a manufacturing cost of the baby bed.

In order to attain the above objects, the folding baby bed according to the present invention comprises a vertically-long rectangular housing frame body portion which can be fixedly attached at the back or bottom portion of the housing frame to a wall surface, a floor surface, or the like, and a bed portion provided at the front upper half portion of the housing frame body portion, the bed portion being pivotally attached to the housing frame body portion at the opposite sides of the base end portion of the bed portion, so that the bed portion can be horizontally extended and vertically folded so as to be housed in the housing frame body portion. When the bed portion is either in the vertically folded state or in the horizontally extended state, the state can be safely maintained by a gas spring device.

Further, the folding baby bed according to the present invention is characterized in that the bed portion is constructed by upper and lower plates, and a trim is interposed between the upper and lower plates.

BRIEF DESCRIPTION OF THE DRAWINGS

Other features and advantages of the present invention will be apparent from the following description taken in connection with the accompanying drawings, wherein.

DETAILED DESCRIPTION OF PREFERRED EMBODIMENTS OF THE INVENTION

Figure 1:
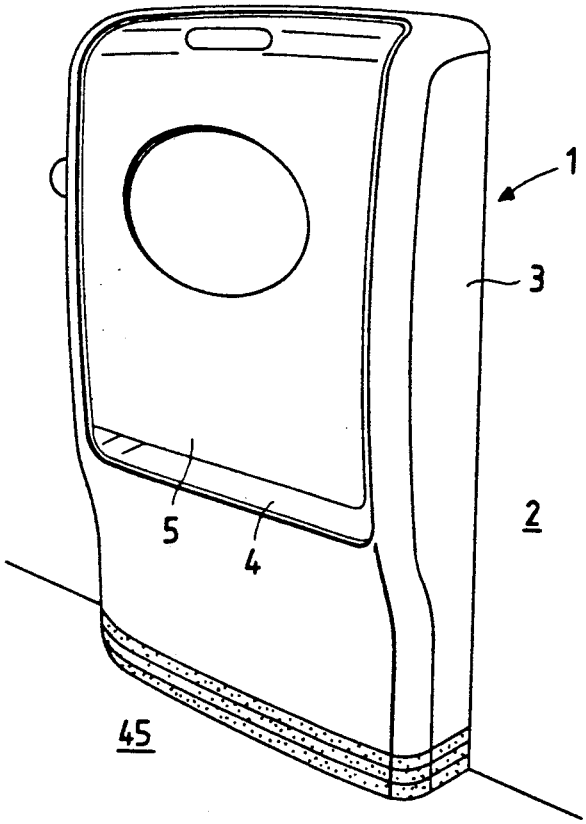
FIG. 1 is a perspective view of an embodiment of the baby bed according to the present invention in a state where the bed portion 5 is vertically folded and housed in the body portion 3.
Figure 2:
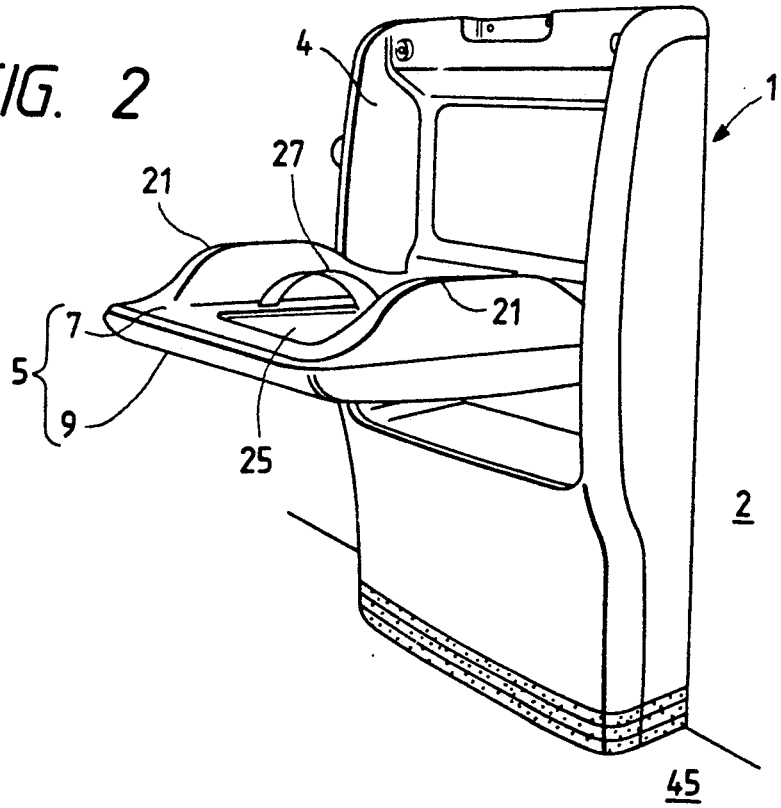
FIG. 2 is a perspective view showing a state where the bed portion is drawn out from the housing frame body portion so as to be horizontally extended.

Referring to the accompanying drawings, embodiments of the folding baby bed according to the present invention will be described hereunder.

FIGS. 1 through 10 show an embodiment of the folding baby bed according to the present invention. The folding baby bed 1 is arranged such that a housing frame body portion 3 fixed to wall 2 is assembled with a bed portion 5 pivoted on the housing frame body portion 3, so that the bed portion 5 can be vertically folded to be housed in the housing frame body portion 3, and horizontally extended from the frame body portion 3.

Figure 6:
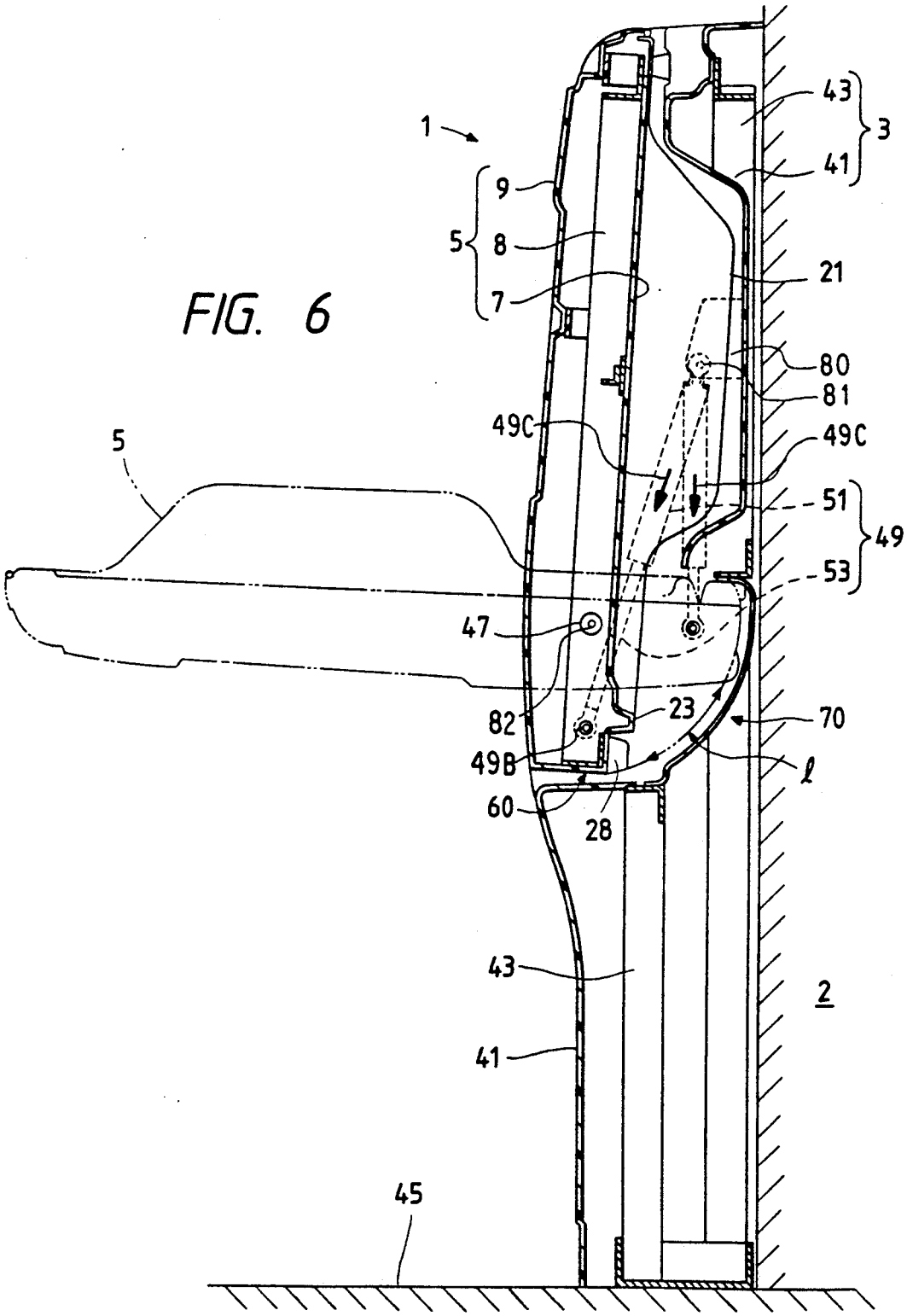
FIG. 6 is a sectional view of the body portion 3.
Figure 7:
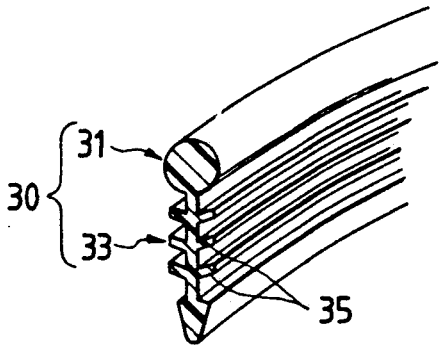
FIG. 7 is a sectional view of a trim 30 component.
Figure 8:
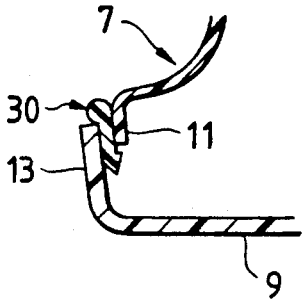
FIG. 8 is a sectional view showing the trim 30.

As shown in FIG. 6, a housing frame body portion 3 is constituted by a box-type panel 41 and a core material 43 which are fixed to each other with screws or the like. The core material or side frame members 43 is fixed to a wall surface or a floor surface.

In the housing frame body portion 3, shafts 47 are provided on the periphery wall of a cavity portion 4, and a bed portion 5 is pivoted on the shafts 47. In the drawing, a gas spring device 49 is constituted by a cylinder portion 51 connected to a cross frame 80 of the body portion 3 through a first shaft 81 and a rod portion 53 connected at its top end to the bed portion 5 through a second shaft 49B. The gas spring device 49 is always urged so as to apply a biasing force to the shaft 49B in the direction of arrow 49C in order to project the rod portion 53, whereby the retracted state, as indicated with solid lines in FIG. 6 where the bed portion 5 is vertically folded, is one stable position for the bed portion 5. On the other hand, when the bed portion 5 is horizontally extended as shown by two-dotted chain lines, the weight of the bed portion 5 overcomes the urging force of the gas spring device 49 so that the horizontal or extended state of the bed portion 5 is maintained. This position is therefore the other stable state or position for the bed portion 5. When the bed portion 5 is inclined upward a little from the horizontal state, the bed portion is automatically housed into the body portion 3 by the operation of the gas spring device 49.

In this embodiment, a lower edge portion 70 of the cavity portion 4 of the housing frame body portion 3 is shaped to have a curved surface. The curved surface is substantially parallel to a locus drawn by an upper right end edge 60 of the bed portion 5 in the drawing when the bed portion 5 is pivoted between positions or turned. Accordingly, even if a nursing bottle or the like enters the inner side of the bed portion 5, the upper right end edge 60 of the bed portion 5 in the drawing is moved along the lower edge of the cavity portion 4 of the housing frame body portion 3 so that the nursing bottle or the like is pushed out by the upper right end edge 60 of the bed portion 5. Accordingly, there is no possibility that the nursing bottle or the like will be is crushed in a space between the bed portion 5 and the housing frame body portion 3.

Although a fine gap is provided between the upper right end edge 60 of the bed portion 5 opposed to the housing frame body portion 3 and the lower edge portion 70 of the cavity portion 4 of the housing frame body portion 3 in this embodiment, it is a matter of course that the edge 60 and the lower edge portion 70 may be formed so as to be a pair of sliding elements.

The basic configuration of the bed portion 5 will be described in detail hereunder.

Figure 5:
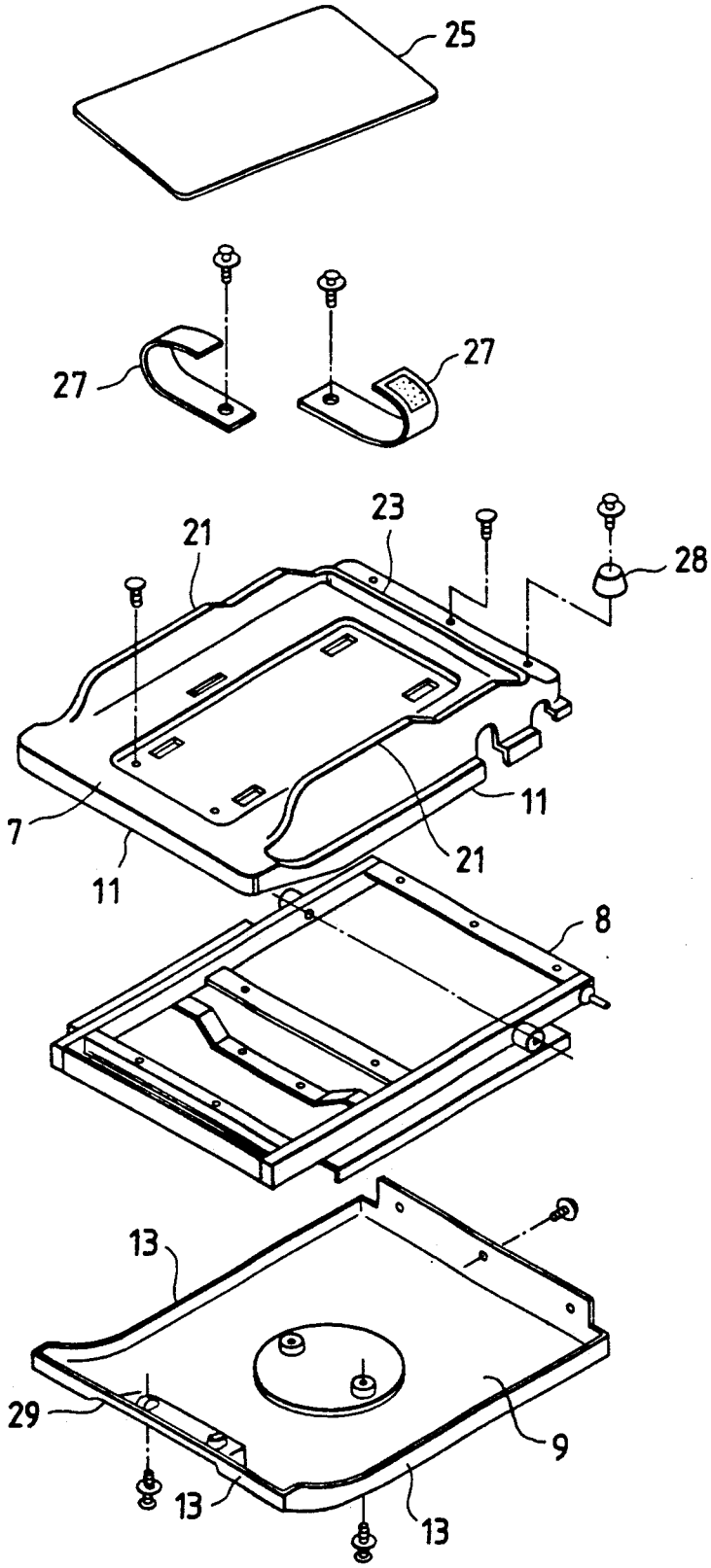
FIG. 5 is an exploded perspective view of the bed portion.

As shown in FIG. 5, the basic configuration of the bed portion 5 is such that a core material 8 is sandwiched between upper and lower plates 7 and 9, the plates 7 and 9 being screwed to the core material 8. A foam material such as urethane or the like is filled between the plates 7 and 9 so as to secure or add to the strength and elasticity of the bed portion 5. In the drawing, the foam material is omitted for the sake of convenience of illustration. Relatively high protrusions 21 are formed on the upper plate 7 so as to extend in a direction departing from the body portion 3 (in the oblique direction from the right upper to the left lower in FIG. 5) so as to prevent a baby from falling out of the bed portion 5. A relatively low protrusion 23 is formed on the side along the housing frame body portion 3 so as to prevent a nursing bottle or the like from entering the inner portion.

A mat 25 and belts 27 are attached to the upper plate 7 so as to serve as a restraining device to protect the baby. In the drawing, the reference numeral 28 represents a rubber stopper.

A recess 29 is formed in the lower plate 9 at its front or left end edge in the drawing. The recess 29 serves as a grip.

Figure 3:
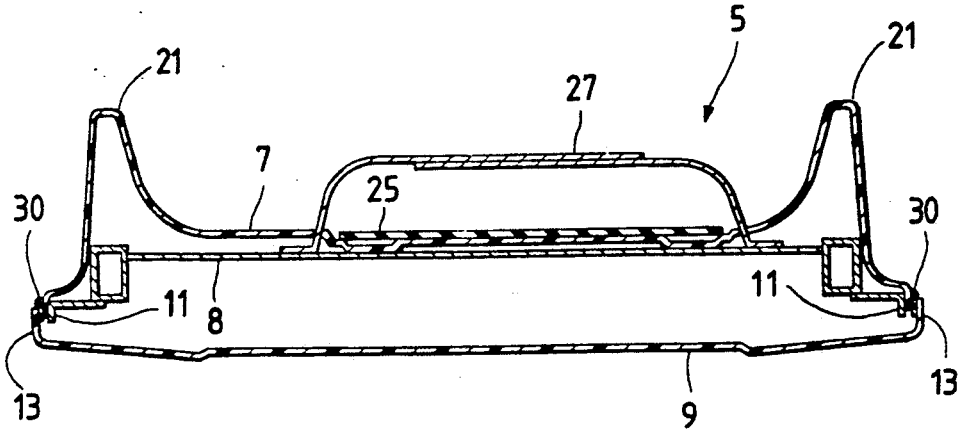
FIG. 3 is a cross sectional view of the bed portion.
Figure 4:
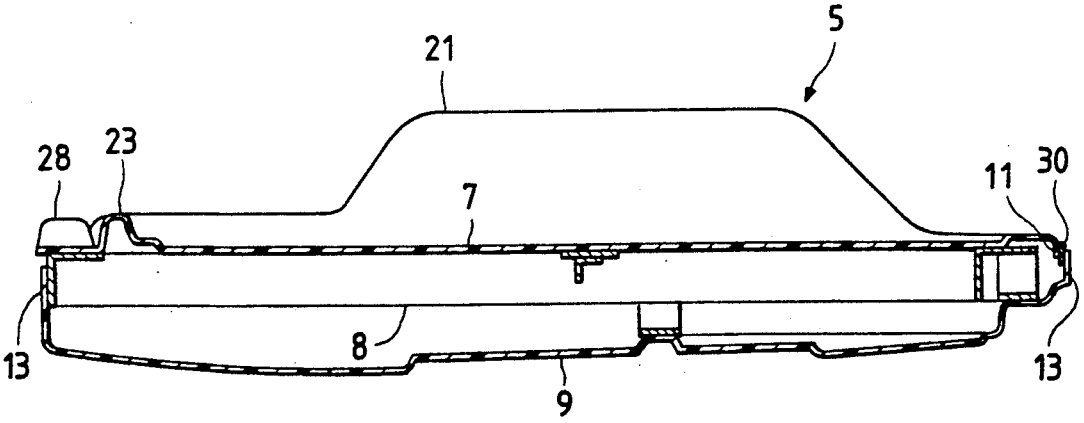
FIG. 4 is a longitudinal sectional view of the bed portion.

As shown in FIGS. 3 and 4, flange portions 11 and 13 are lapped on the upper and lower plates 7 and 9 respectively. A trim 30 is interposed between the flange portions 11 and 13 so as to have an interference-fit relation therebetween. The trim 30 is an extruded product of soft vinyl chloride resin and is constituted by a head portion 31 (FIG. 7) having a circular cross section and a leg portion 33 having a cross section like a tree having branches. The leg portion 33 of the trim 30 is interposed between the flanges 1 and 13. Since the leg portion 33 is made of the soft material and the little branch 35 portions can be transformed, even if the size of the gap between the flanges 11 and 13 changes, the leg portion 33 follows the change thereby to maintain a tight fit between flanges 11 and 13. Accordingly, the plates 7 and 9 never flap, and because the gap between the flanges 7 and 9 at their circumferential edges is closed, dust or the like never enters the gap. Further, since the head portion 31 having a fixed shape is exposed, the lapped portions of the flanges 11 and 13 have a pleasing appearance.

Figure 9:
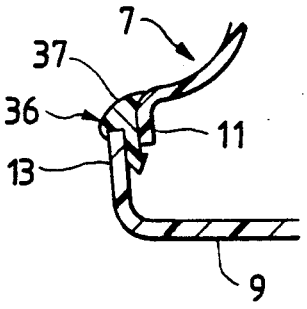
FIG. 9 is a sectional view showing a modified trim 36.

FIG. 9 shows a modified trim 36. If the modified trim 36 having a head portion 37 which is shaped in the form of an umbrella or cap so as to cover the lapped portions of the flanges 11 and 13 is used, the design and safeness at this portion can be improved.

Figure 12:
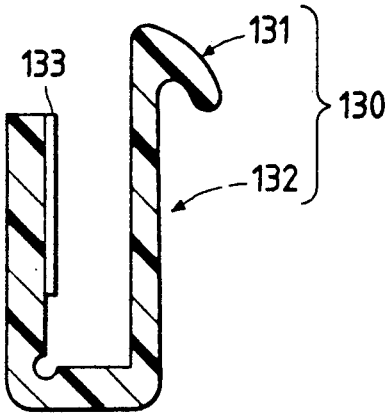
FIG. 12 is a sectional view of another modified trim 130.
Figure 13:
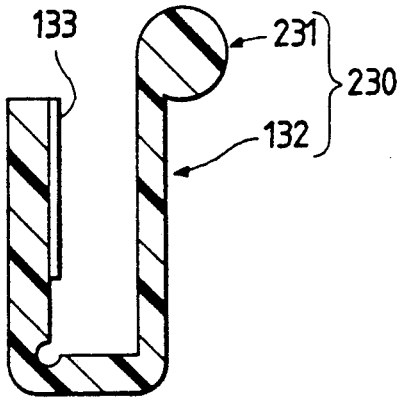
FIG. 13 is a sectional view of yet another modified trim 230.
Figure 14:
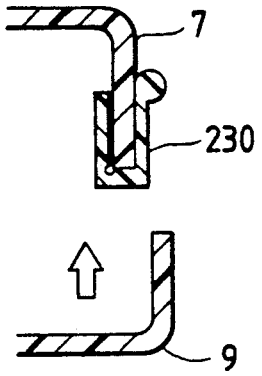
FIG. 14 is a sectional view showing a manner in which the upper and lower plates are lapped with use of the modified trim 230.
Figure 15:
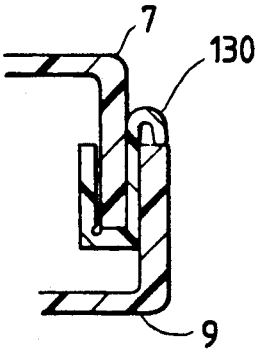
FIG. 15 is a sectional view showing a state where the modified trim 130 is used.
Figure 16:
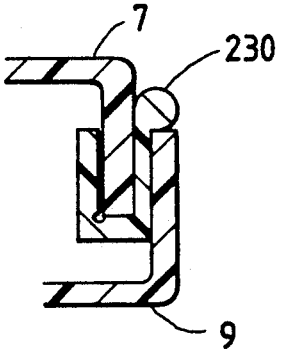
FIG. 16 is a sectional view showing the modified trim 230.

FIGS. 12 and 13 show modified trims 130 and 230. The trim 130 is provided with a head portion 131 which is substantially in the form of a J-shape in cross section and a leg portion 132 which is in the form of a U-shape in cross section. The modified trim 230 is provided with a head portion 231 having a circular cross section and the same leg as that of the modified trim 130. The modified trims 130 and 230 are provided on the legs 132 with adhesive tapes 133, respectively. As is apparent from FIG. 14, the trim can be attached to the upper plate 7 by an adhesive tape provided on the leg prior to lapping the upper and lower plates, thus improving the working efficiency. FIG. 15 is a sectional view showing a state where the modified trim 130 is used. FIG. 16 is a sectional view showing a state where the modified trim 230 is used.

Figure 10:
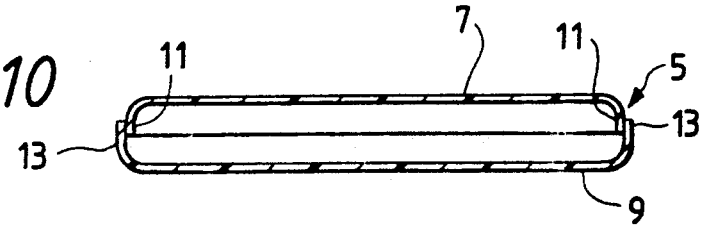
FIG. 10 is a sectional view showing the connection between the flanges 11 and 13 of the upper and lower plates 7 and 9 without using the trim.
Figure 11:
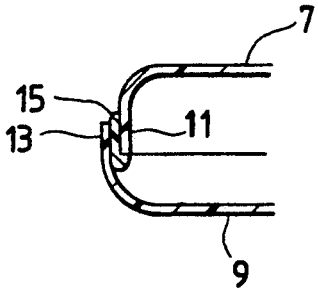
FIG. 11 is a partial enlarged view of FIG. 10.

As shown in FIGS. 10 and 11, the flange portions 11 and 13 of the plates 7 and 9 are lapped over each other so as not to make a gap therebetween at their circumferential edge portions, and the flange portions 11 and 13 are bonded with each other through an adhesive layer 15. However, the adhesive method is somewhat disadvantageous. That is, if the trim is interposed in the interference fit state in the portion where the respective flange portions of the upper and lower plates are lapped over each other, the gap between the flange portions is closed. When the bed portion is manufactured, it is not necessary to apply an adhesive into the gap, and labor is therefore saved in manufacturing. As an advantage, the adhesive never leaks from the gap between the flange portions, so that the design of the portion where the flange portions are lapped over each other is improved.

With the use of trim as opposed to adhesive, even if the gap between the flange portions is uneven, the unevenness of the gap can be absorbed because the trim is made of a soft material so that the trim is transformed. Accordingly, high dimensional accuracy becomes unnecessary in the plates constituting the bed portion. Accordingly, the plates can be molded with good yield in a relatively inexpensive manufacturing method such as a vacuum molding method or the like, resulting in reduction in a manufacturing cost of the products.

What is claimed is:

1. A folding baby bed comprising:

a body portion including side and cross frame members and having a cavity portion formed in a front upper half portion thereof;

a bed portion pivotally attached to at least one of said side frame members through pivotal shafts projected from said bed portion at opposite end portions thereof and in a vicinity of a lower end portion thereof, so that said bed portion is able to be vertically folded and horizontally extended, said bed portion having a base end portion which abuts on at least one of said cross frame members so that said bed portion is maintained in a horizontal state when said bed portion is horizontally extended, said bed portion being housed in said cavity portion formed in said body portion when said bed portion is in a vertically folded state, said bed portion being provided with upper and lower plates having flanges vertically projected from the circumferential edges of said plates respectively, said flanges of said lower plate being located at the outside of said flanges of said upper plate, or vice versa, so as to be lapped over each other with a trim of a soft material interposed between said lapped-over flanges; and posture maintaining urging means provided between said body portion and said bed portion for maintaining said bed portion in at least one of said vertically folded and horizontally extended state.

2. A folding baby bed according to claim 1, in which said posture maintaining urging means includes a gas spring having a projecting urging force, said gas spring being supported by a first support shaft connected to at least one of said side frame members of said body portion and a second support shaft connected at a lower end portion of said bed portion, said urging force being overcome by a weight of said bed portion when said bed portion is brought into the horizontally extended state.

3. A folding bed according to claim 1, wherein said trim includes a head portion having a circular cross section, and a leg portion having a plurality of branch portions.

4. A folding bed according to claim 1, wherein said trim includes a head portion having a cap-shaped cross section.

5. A folding bed according to claim 1, wherein said trim includes a head portion having a J-shaped cross section and a leg portion having a U-shaped cross section.

6. A folding bed according to claim 1, wherein said trim includes a head portion having a circular cross section and a leg portion having a U-shaped cross section.

7. A folding baby bed comprising:

a body portion having side and cross frame members and having a cavity portion formed in a front upper half portion thereof;

a bed portion pivotally attached to at least one of said side frame members through pivotal shafts projected from said bed portion at opposite end portions thereof and in a vicinity of a lower end portion thereof, so that said bed portion is able to be vertically folded and horizontally extended, said bed portion having a base end portion which abuts on at least one of said cross frame members so that said bed portion is maintained in a horizontal state when said bed portion is horizontally extended, said bed portion being housed in said cavity portion formed in said body portion when said bed portion is in a vertically folded state; and posture maintaining urging means provided between said body portion and said bed portion for maintaining said bed portion in at least one of said vertically folded and horizontally extended state, in which a front lower end surface portion of a circumferential wall of said cavity portion has a curved surface, said curved surface being substantially parallel to a locus drawn by an edge of said bed portion facing said body portion when said bed portion is selectively vertically folded and horizontally extended.

8. A folding baby bed according to claim 7, in which said posture maintaining urging means includes a gas spring having a projecting urging force, said gas spring being supported by a first support shaft connected to at least one of said side frame members of said body portion and a second support shaft connected at a lower end portion of said bed portion, said urging force being overcome by a weight of said bed portion when said bed portion is brought into a horizontally extended state.

* * * * *